US005865195A

United States Patent [19]

Carter

[11] Patent Number: 5,865,195

[45] Date of Patent: Feb. 2, 1999

[54] ORAL HYGIENE SYSTEM

[76] Inventor: Theresa Carter, P.O. Box 91632, Louisville, Ky. 40291

[21] Appl. No.: 888,184

[22] Filed: Jul. 3, 1997

[51] Int. Cl.[6] ..... A45D 44/18

[52] U.S. Cl. ..... 132/309; 132/311

[58] Field of Search ..... 132/309, 308, 132/311; 401/268

[56] References Cited

U.S. PATENT DOCUMENTS

| | | | |
|---|---|---|---|
| 1,279,507 | 9/1918 | Briggs | 132/309 |
| 1,349,110 | 8/1920 | Snyder | 132/311 |
| 1,792,429 | 2/1931 | Klinger | 132/309 |
| 2,888,008 | 5/1959 | Rosenthal | 132/309 |
| 3,353,898 | 11/1967 | Lamberti | 132/308 |
| 4,522,524 | 6/1985 | Green . | |
| 4,530,129 | 7/1985 | Labick et al. | 132/308 |
| 4,821,752 | 4/1989 | Widlak | 132/311 |
| 4,850,730 | 7/1989 | Jimenez et al. . | |
| 4,961,717 | 10/1990 | Hickey | 132/308 |
| 4,987,910 | 1/1991 | Lowe | 132/309 |
| 5,033,898 | 7/1991 | Williams . | |
| 5,338,124 | 8/1994 | Spicer et al. . | |

*Primary Examiner*—Todd E. Manahan
*Assistant Examiner*—Eduardo C. Robert
*Attorney, Agent, or Firm*—Joseph N. Breaux

[57] ABSTRACT

A system for maintaining oral hygiene that includes a sealed storage/rinsing tube and a hygiene assembly sealed within the storage/rinsing tube by an adhesively attached peel off seal member. The storage/rinsing tube is used as a water vessel for assisting in rinsing the mouth with water. The hygiene assembly includes a toothbrush head portion, a handle portion, a dental stimulator secured to an exterior surface of the handle portion, a length of dental floss, a supply of toothpaste, and a supply of a mouthwash solution.

12 Claims, 2 Drawing Sheets

ORAL HYGIENE SYSTEM

TECHNICAL FIELD

The present invention relates to toothbrushes and the like and more particularly to an oral hygiene system that includes a sealed storage/rinsing tube having an insertion and removal opening and a hygiene assembly sealed within the storage/rinsing tube by an adhesively attached peel off seal member secured over the insertion and removal opening; the hygiene assembly including a toothbrush head portion, a handle portion, a dental stimulator secured to an exterior surface of the handle portion, a length of dental floss, a supply of toothpaste, and a supply of a mouthwash solution; the head portion including a head member, bristles extending from a first surface of the head member, a flexible dispensing membrane secured to a second surface of the head member, a toothpaste storage reservoir defined between the second surface of the head member and the flexible dispensing membrane, and a number of dispensing orifices formed through the head member between the toothpaste storage reservoir and the first surface of the head member; the handle portion having a dental floss spool integrally formed circumferentially around the handle portion adjacent to a cap end of the handle portion, a mouthwash reservoir formed within the handle portion having a reservoir opening formed at the cap end of the handle portion, a flip top cap having a sealing ring, and a flexible cap hinge portion extending between the cap end of the handle portion and the flip top cap, the cap end of the handle portion having sealing channel formed circumferentially around the reservoir opening, the sealing ring of the flip top cap being sized and positionable into the sealing channel in a manner to seal the reservoir opening; the length of dental floss being wound onto the dental floss spool, the supply of toothpaste being positioned within the toothpaste storage reservoir; the supply of mouthwash solution being sealed within the mouthwash reservoir, the handle portion being integrally formed with a tapered end of the head member of the head portion.

BACKGROUND OF THE INVENTION

Proper oral hygiene is important to maintain healthy teeth and gums. Although many individuals practice good oral hygiene when home, they often do not have the necessary dental equipment and supplies available to them when traveling or away from home for brief periods. It would be a benefit to these individuals to have an oral hygiene system that included the dental equipment and supplies to continue to practice proper oral hygiene when away from home. In addition, because it can often be desirable to perform oral hygiene procedures such as brushing the teeth, flossing and using a mouthwash solution after dining at a public restaurant, it would also be a benefit to have an oral hygiene system that could easily be dispensed from a vending machine to eliminate the need for carrying the oral hygiene system. It would of course be desirable to have such an oral hygiene system that was disposable.

SUMMARY OF THE INVENTION

It is thus an object of the invention to provide an oral hygiene system.

It is a further object of the invention to provide an oral hygiene system that includes dental equipment and supplies used to practice proper oral hygiene.

It is a still further object of the invention to provide an oral hygiene system that is packaged in an easily dispensed format.

It is a still further object of the invention to provide an oral hygiene system that is disposable.

It is a still further object of the invention to provide an oral hygiene system that includes a sealed storage/rinsing tube having an insertion and removal opening and a hygiene assembly sealed within the storage/rinsing tube by an adhesively attached peel off seal member secured over the insertion and removal opening; the hygiene assembly including a toothbrush head portion, a handle portion, a dental stimulator secured to an exterior surface of the handle portion, a length of dental floss, a supply of toothpaste, and a supply of a mouthwash solution; the head portion including a head member, bristles extending from a first surface of the head member, a flexible dispensing membrane secured to a second surface of the head member, a toothpaste storage reservoir defined between the second surface of the head member and the flexible dispensing membrane, and a number of dispensing orifices formed through the head member between the toothpaste storage reservoir and the first surface of the head member; the handle portion having a dental floss spool integrally formed circumferentially around the handle portion adjacent to a cap end of the handle portion, a mouthwash reservoir formed within the handle portion having a reservoir opening formed at the cap end of the handle portion, a flip top cap having a sealing ring, and a flexible cap hinge portion extending between the cap end of the handle portion and the flip top cap, the cap end of the handle portion having sealing channel formed circumferentially around the reservoir opening, the sealing ring of the flip top cap being sized and positionable into the sealing channel in a manner to seal the reservoir opening; the length of dental floss being wound onto the dental floss spool, the supply of toothpaste being positioned within the toothpaste storage reservoir; the supply of mouthwash solution being sealed within the mouthwash reservoir, the handle portion being integrally formed with a tapered end of the head member of the head portion.

It is a still further object of the invention to provide an oral hygiene system that accomplishes some or all of the above objects in combination.

Accordingly, an oral hygiene system is provided. The oral hygiene system includes a sealed storage/rinsing tube having an insertion and removal opening and a hygiene assembly sealed within the storage/rinsing tube by an adhesively attached peel off seal member secured over the insertion and removal opening; the hygiene assembly including a toothbrush head portion, a handle portion, a dental stimulator secured to an exterior surface of the handle portion, a length of dental floss, a supply of toothpaste, and a supply of a mouthwash solution; the head portion including a head member, bristles extending from a first surface of the head member, a flexible dispensing membrane secured to a second surface of the head member, a toothpaste storage reservoir defined between the second surface of the head member and the flexible dispensing membrane, and a number of dispensing orifices formed through the head member between the toothpaste storage reservoir and the first surface of the head member; the handle portion having a dental floss spool integrally formed circumferentially around the handle portion adjacent to a cap end of the handle portion, a mouthwash reservoir formed within the handle portion having a reservoir opening formed at the cap end of the handle portion, a flip top cap having a sealing ring, and a flexible cap hinge portion extending between the cap end of the handle portion and the flip top cap, the cap end of the handle portion having sealing channel formed circumferentially around the reservoir opening, the sealing ring of the flip top cap being sized and positionable into the sealing channel in a manner to seal the reservoir opening; the length of dental floss being wound onto the dental floss spool, the supply of toothpaste being positioned within the toothpaste storage reservoir; the supply of mouthwash solution being sealed within the mouthwash reservoir, the handle portion being integrally formed with a tapered end of the head member of the head portion. The term "toothpaste" is used herein to mean a tooth cleaning preparation used in combination with a toothbrush. The term "mouthwash solution" is used herein to mean a solution for cleansing the mouth and freshening the breath.

BRIEF DESCRIPTION OF THE DRAWINGS

For a further understanding of the nature and objects of the present invention, reference should be made to the following detailed description, taken in conjunction with the accompanying drawings, in which like elements are given the same or analogous reference numbers and wherein.

DESCRIPTION OF THE EXEMPLARY EMBODIMENT

Figure 1:
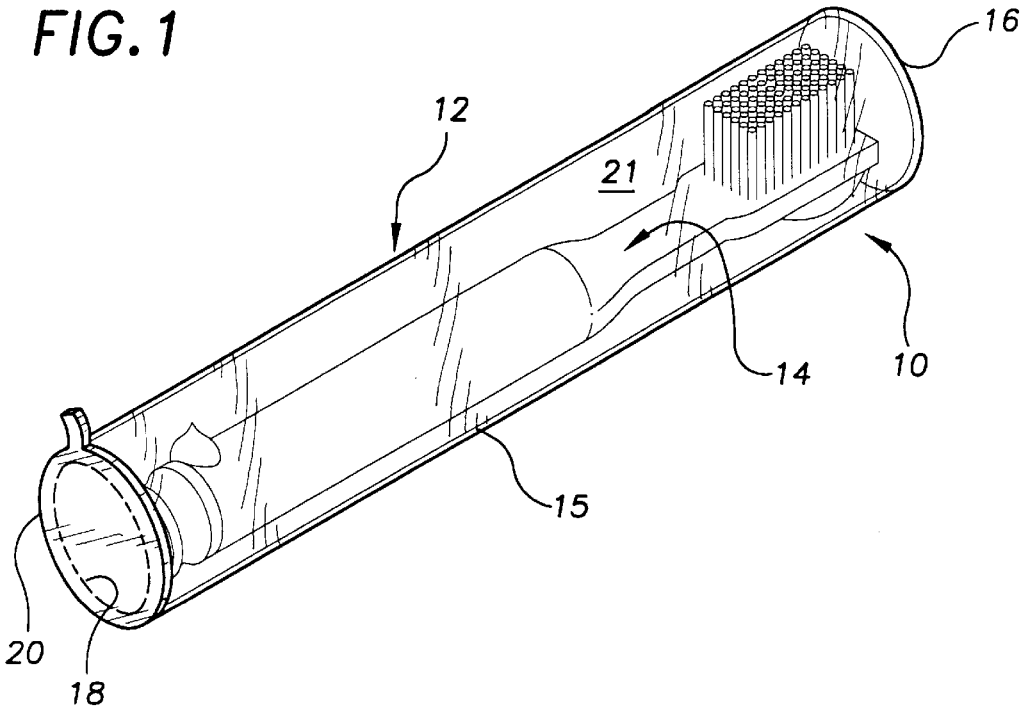
FIG. 1 is a perspective view of an exemplary embodiment of the oral hygiene system of the present invention showing an exemplary embodiment of the storage/rinsing tube and an exemplary embodiment of the hygiene assembly sealed within the storage/rinsing tube by an adhesively attached peel off seal member.

FIG. 1 shows an exemplary embodiment of the oral hygiene system of the present invention, generally designated by the numeral 10. Exemplary oral hygiene system 10 includes a storage/rinsing tube, generally designated 12; and a hygiene assembly, generally designated 14. In this embodiment, storage/rinsing tube 12 is a clear plastic tube 15 having a closed end 16 and a circular shaped insertion and removal opening 18 (defined by dashed lines) at the opposite end that is sealed over by an adhesively attached peel off seal member 20. Clear plastic tube 15 has a storage cavity 21 formed therein sized sufficiently to receive hygiene assembly 14 therein. In use, storage cavity 21 of clear plastic tube 15 is used to hold and transfer rinsing water to the mouth.

Figure 2:
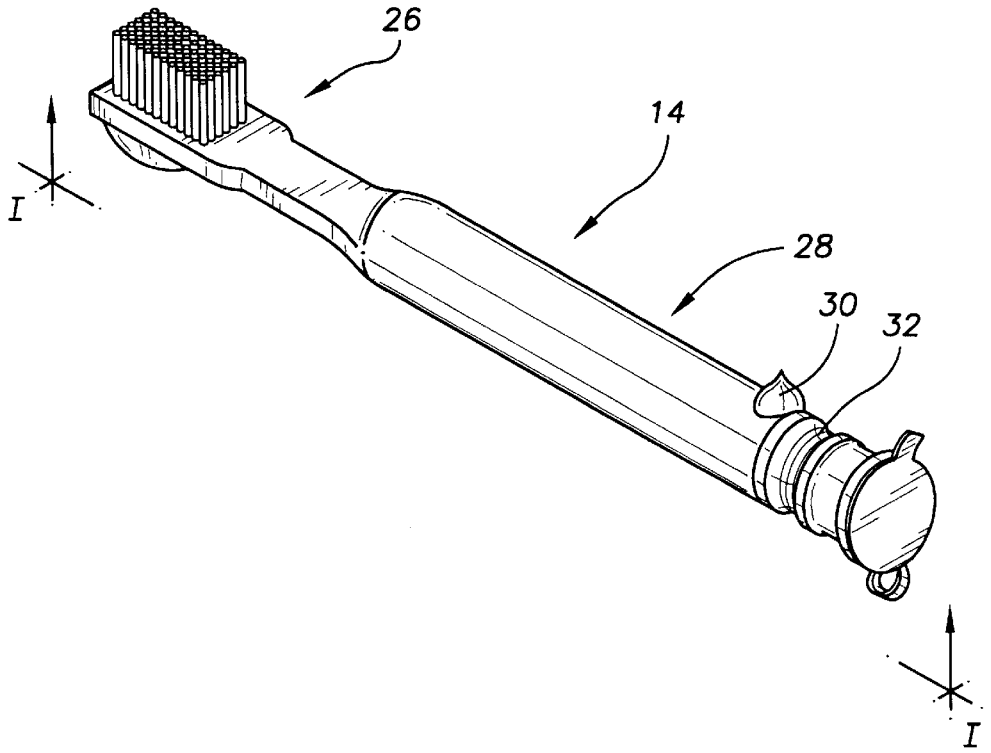
FIG. 2 is a perspective view of the exemplary hygiene assembly or FIG. 1 in isolation showing the toothbrush head portion, the flexible toothpaste dispensing membrane, the handle portion, the dental stimulator, the dental floss spool, the dental floss, and the flip top cap sealing the opening to the mouthwash reservoir.

With reference to FIG. 2, hygiene assembly 14 includes a toothbrush head portion, generally designated 26; a handle portion, generally designated 28; a resilient plastic dental stimulator 30 secured to an exterior surface of handle portion 28; a length of dental floss 32 (also shown in FIGS. 3 and 3B), a supply of toothpaste 34 (FIG. 3A), and a supply of a mouthwash solution contained within handle portion 28.

Figure 3:
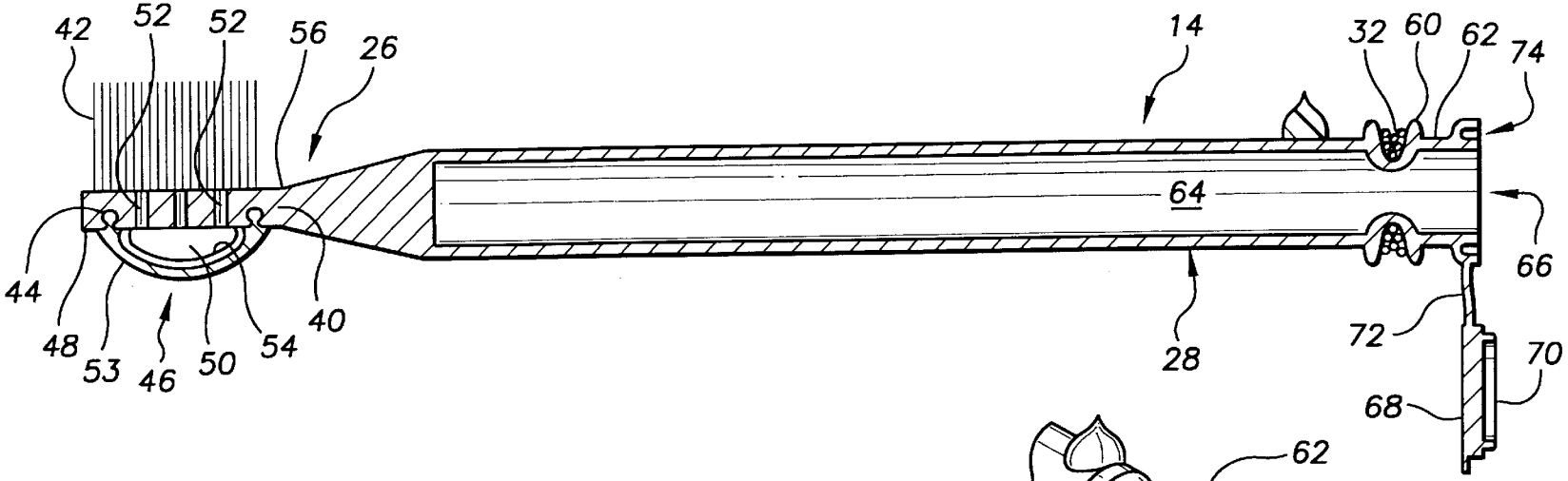
FIG. 3 is a cross-sectional view of the exemplary hygiene assembly of FIG. 2 along the line I—I showing the toothbrush head portion including the bristles, the dispensing orifices, the toothpaste storage reservoir, and the flexible dispensing membrane; and the handle portion showing the dental stimulator adhesively secured to the exterior of the handle portion, the dental floss spool formed circumferentially around the handle portion adjacent to the cap end of the handle portion, the dental floss wound onto the dental floss spool, the mouthwash reservoir, the reservoir opening of the mouthwash reservoir, the sealing channel formed circumferentially around the reservoir opening, the flexible cap hinge portion and the flip top cap with the sealing ring.

With reference to FIG. 3, head portion 26 includes a molded plastic head member 40, nylon bristles 42 extending from a first surface 44 of head member 40, a flexible dispensing membrane, generally designated 46 secured to a second surface 48 of head member 40, a toothpaste storage reservoir 50 defined between second surface 48 of head member 40 and flexible dispensing membrane 46, and a number of dispensing orifices 52 formed through head member 40 between toothpaste storage reservoir 50 and first surface 44 of head member 40. In this embodiment dispensing membrane 46 includes a flexible polyethylene plastic layer 53 and a flexible aluminum coating layer 54. Aluminum coating layer 54 is positioned adjacent to toothpaste storage reservoir 50. When it is desired to brush the teeth with hygiene assembly 14, referring now to FIG. 3A, dispensing membrane 46 is depressed to force the supply of toothpaste 34 stored within toothpaste storage reservoir 50 (FIG. 3) out through dispensing orifices 52 and into bristles 42 for use in the conventional fashion.

Figure 3B:
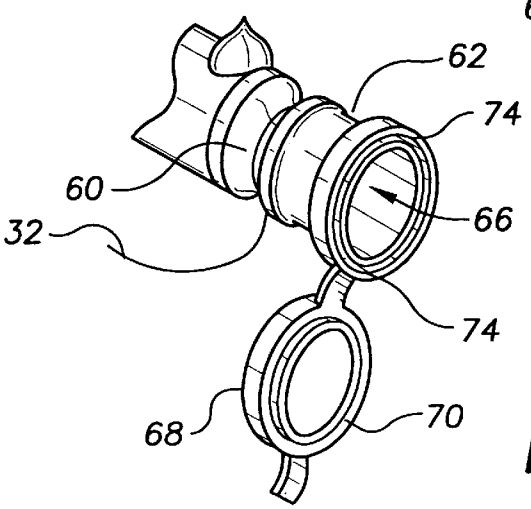
FIG. 3B is a detail perspective view showing an end of the dental floss unwound from the dental floss spool and the flip top cap with the sealing ring flipped down to show the reservoir opening of the mouthwash reservoir.
Figure 3A:
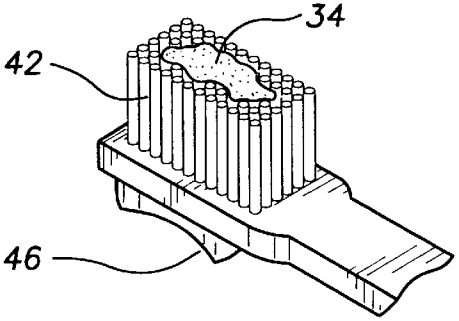
FIG. 3A is a detail perspective view showing the toothbrush head portion with the flexible dispensing membrane forced down to force a quantity of toothpaste from the toothpaste storage reservoir into the bristles.

With reference back to FIG. 3, handle portion 28 is integrally molded with a tapered end 56 of head member 40. Handle portion 28 has a dental floss spool 60 integrally formed circumferentially around a cap end 62 thereof, a mouthwash reservoir 64 formed therein, a reservoir opening 66 formed at cap end 62 in connection with mouthwash reservoir 64, a flip top cap 68 having a sealing ring 70, and a flexible cap hinge portion 72 extending between cap end 62 and flip top cap 68. With reference to FIG. 3B, cap end 62 has a circumferential sealing channel 74 (also shown in FIG. 3) formed circumferentially around reservoir opening 66. Sealing ring 70 of flip top cap 68 is sized and positionable into sealing channel 74 in a manner to create a Liquid tight seal over reservoir opening 66 to seal the quantity of mouthwash solution within mouthwash reservoir 64 (FIG. 3). Dental floss 32 is wound onto dental floss spool 60. When needed, the entire length of dental floss 32 is unwound, used and discarded. In this embodiment a two and one-half foot length of unwaxed dental floss is provided.

It can be seen from the preceding description that an oral hygiene system has been provided that includes dental equipment and supplies used to practice oral hygiene; that is packaged in an easily dispensed format; that is disposable; and that includes a sealed storage/rinsing tube having an insertion and removal opening and a hygiene assembly sealed within the storage/rinsing tube by an adhesively attached peel off seal member secured over the insertion and removal opening; the hygiene assembly including a toothbrush head portion, a handle portion, a dental stimulator secured to an exterior surface of the handle portion, a length of dental floss, a supply of toothpaste, and a supply of a mouthwash solution; the head portion including a head member, bristles extending from a first surface of the head member, a flexible dispensing membrane secured to a second surface of the head member, a toothpaste storage reservoir defined between the second surface of the head member and the flexible dispensing membrane, and a number of dispensing orifices formed through the head member between the toothpaste storage reservoir and the first surface of the head member; the handle portion having a dental floss spool integrally formed circumferentially around the handle portion adjacent to a cap end of the handle portion, a mouthwash reservoir formed within the handle portion having a reservoir opening formed at the cap end of the handle portion, a flip top cap having a sealing ring, and a flexible cap hinge portion extending between the cap end of the handle portion and the flip top cap, the cap end of the handle portion having sealing channel formed circumferentially around the reservoir opening, the sealing ring of the flip top cap being sized and positionable into the sealing channel in a manner to seal the reservoir opening; the length of dental floss being wound onto the dental floss spool, the supply of toothpaste being positioned within the toothpaste storage reservoir; the supply of mouthwash solution being sealed within the mouthwash reservoir, the handle portion being integrally formed with a tapered end of the head member of the head portion.

It is noted that the embodiment of the oral hygiene system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. An oral hygiene system comprising:

a sealed storage/rinsing tube having an insertion and removal opening; and a hygiene assembly sealed within said storage/rinsing tube by an adhesively attached peel off seal member secured over said insertion and removal opening;

said hygiene assembly including: a toothbrush head portion, a handle portion, a length of dental floss, a supply of toothpaste, and a supply of a mouthwash solution;

said head portion including a head member, bristles extending from a first surface of said head member, a flexible dispensing membrane secured to a second surface of said head member, a toothpaste storage reservoir defined between said second surface of said head member and said flexible dispensing membrane, and a number of dispensing orifices formed through said head member between said toothpaste storage reservoir and said first surface of said head member;

said handle portion having a dental floss spool integrally formed circumferentially therearound, a mouthwash reservoir formed within said handle portion having a reservoir opening formed at a cap end of said handle portion, a flip top cap having a sealing ring, and a flexible cap hinge portion extending between said cap end of said handle portion and said flip top cap, said cap end of said handle portion having sealing channel formed circumferentially around said reservoir opening, said sealing ring of said flip top cap being sized and positionable into said sealing channel in a manner to form a liquid tight seal over said reservoir opening; said length of dental floss being wound onto said dental floss spool;

said supply of toothpaste being positioned within said toothpaste storage reservoir;

said supply of mouthwash solution being sealed within said mouthwash reservoir;

said handle portion being integrally formed with said head member of said head portion.

2. The oral hygiene system of claim 1, further including:

a dental stimulator secured to an exterior surface of said handle portion.

3. The oral hygiene system of claim 2 wherein:

said dental floss spool is integrally formed circumferentially around said handle portion adjacent to said cap end of said handle portion.

4. The oral hygiene system of claim 2, wherein:

said flexible dispensing membrane includes a plastic layer and a flexible aluminum layer.

5. The oral hygiene system of claim 4 wherein:

said dental floss spool is integrally formed circumferentially around said handle portion adjacent to said cap end of said handle portion.

6. The oral hygiene system of claim 4 wherein:

said flexible aluminum layer is positioned adjacent to said toothpaste storage reservoir.

7. The oral hygiene system of claim 6 wherein:

said dental floss spool is integrally formed circumferentially around said handle portion adjacent to said cap end of said handle portion.

8. The oral hygiene system of claim 1, wherein:

said flexible dispensing membrane includes a plastic layer and a flexible aluminum layer.

9. The oral hygiene system of claim 8 wherein:

said dental floss spool is integrally formed circumferentially around said handle portion adjacent to said cap end of said handle portion.

10. The oral hygiene system of claim 8 wherein:

said flexible aluminum layer is positioned adjacent to said toothpaste storage reservoir.

11. The oral hygiene system of claim 10 wherein:

said dental floss spool is integrally formed circumferentially around said handle portion adjacent to said cap end of said handle portion.

12. The oral hygiene system of claim 1 wherein:

said dental floss spool is integrally formed circumferentially around said handle portion adjacent to said cap end of said handle portion.

* * * * *